US006996360B2

(12) United States Patent
Koga et al.

(10) Patent No.: US 6,996,360 B2
(45) Date of Patent: Feb. 7, 2006

(54) APPARATUS AND METHOD OF TRANSFERRING IMAGE ON INTERMEDIATE MEDIUM ONTO RECORDING MEDIUM

(75) Inventors: Yoshiro Koga, Nagano-ken (JP); Atsunori Kitazawa, Nagano-ken (JP); Toru Fujita, Nagano-ken (JP); Masahide Nakamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 112 days.

(21) Appl. No.: 10/662,939

(22) Filed: Sep. 16, 2003

(65) Prior Publication Data

US 2004/0126153 A1 Jul. 1, 2004

(30) Foreign Application Priority Data

Sep. 27, 2002 (JP) ..... 2002-284300
Oct. 30, 2002 (JP) ..... 2002-315635

(51) Int. Cl.
*G03G 15/16* (2006.01)

(52) U.S. Cl. ..... 399/296; 399/307; 399/308

(58) Field of Classification Search ..... 399/296, 399/66, 307, 302, 308
See application file for complete search history.

(56) References Cited

U.S. PATENT DOCUMENTS 4,531,825 A * 7/1985 Miwa et al. ..... 399/308
6,133,927 A * 10/2000 Arai et al. ..... 399/308
6,173,147 B1 1/2001 Nakashima et al.
6,353,721 B1 * 3/2002 Yamaguchi et al. ..... 399/302
6,356,731 B1 * 3/2002 Shinjo ..... 399/307
6,377,771 B1 * 4/2002 Verluyten et al. ..... 399/302
6,577,837 B2 6/2003 Iida et al.
2002/0106220 A1 * 8/2002 Nakashima et al. ..... 399/307
2002/0146258 A1 10/2002 Iida et al.

FOREIGN PATENT DOCUMENTS

EP 0 935 173 A1 8/1999
JP 2-273771 A 11/1990
JP 2759487 B2 5/1998
JP 11-167295 A 6/1999
JP 2002-123114 A 4/2002
WO WO 99/10778 A1 3/1999

* cited by examiner

*Primary Examiner*—Susan Lee
(74) *Attorney, Agent, or Firm*—Sughrue Mion, PLLC

(57) ABSTRACT

As an urging member 50 urges a front surface side roller 48 against a back surface side roller 45, the front surface side roller 48 and the back surface side roller 45 bring an intermediate transfer belt 41 and a recording medium 4 into pressure contact with each other at a secondary transfer position 49. The thermal capacity per unit surface area of each one of the front surface side roller 48 and the back surface side roller 45 is larger than the thermal capacity per unit surface area of the intermediate transfer belt 41. Further, the thermal capacity per unit surface area of the back surface side roller 45 is larger than the thermal capacity per unit surface area of the front surface side roller 48.

20 Claims, 9 Drawing Sheets

APPARATUS AND METHOD OF TRANSFERRING IMAGE ON INTERMEDIATE MEDIUM ONTO RECORDING MEDIUM

BACKGROUND OF THE INVENTION

1. Field of the Invention

The present invention relates to an image forming apparatus for and an image forming method of forming a toner image on a recording medium such as a copy paper, a transfer paper, other general paper, etc.

2. Description of the Related Art

A conventional image forming apparatus such as a printer, a copier machine and a facsimile machine has a structure that a toner image formed on an image carrier such as a photosensitive member and an intermediate transfer medium is transferred onto a recording medium and the toner image is then fixed on the recording medium. To be more specific, for the purpose of executing this transfer process, transfer means such as a conductive and elastic transfer roller and a transfer belt is disposed facing the image carrier. The recording medium is made to move passed this opposed position, namely, a transfer position in synchronization to movement of the image carrier, and a transfer bias is applied upon the transfer means in accordance with the traveling of the recording medium. The toner image carried by the image carrier is consequently transferred on the recording medium. The recording medium to which the toner image has thus been transferred is transported to fixing means and subjected to pressure and heat, thereby fixing the toner image on the recording medium.

In an image forming apparatus which performs double-sided printing, after a toner image is transferred and fixed on one surface of a recording medium in the manner described above, the other surface of the recording medium is subjected to similar transfer/fixing. However, when the both surfaces are subjected to a transfer process and a fixing process under the same conditions, even though printing on one surface (first stage printing) is excellent, printing on the other surface (second stage printing) may not be favorable in some cases. To solve this problem, Japanese Patent Application Laid-Open Gazette No. H2-273771 for example describes to perform double-sided printing while ensuring that a transfer condition for first stage printing is different from that for second stage printing.

The conventional apparatus described above however requires to change a transfer condition between first stage printing and second stage printing, and demands complex transfer control. In the case of an image forming apparatus which forms a color image in particular, toner images in four colors are superposed one atop the other on an image carrier and a resulting color toner image is transferred onto a recording medium. And therefore, it is necessary to strictly control a transfer condition. Hence, in the conventional apparatus described above, it is needed to separately control transfer conditions between first stage printing and second stage printing and strictly control a transfer condition during each printing, which adds to the complexity of the transfer control.

Further, in this type of image forming apparatus, a toner image, which has been formed on an image carrier such as a photosensitive member, is put temporarily on an intermediate transfer medium such as an intermediate transfer belt and an intermediate transfer drum in some cases. While such image forming apparatuses require to secondarily transfer a primary transfer toner image carried by an intermediate transfer medium onto a recording medium, in some of these image forming apparatuses, the toner image is fixed on the recording medium concurrently with the secondary transfer process.

In an apparatus which transfers and fixes at the same time as mentioned above, it is necessary to heat up an intermediate transfer medium, melt toner particles which form a primarily transferred toner image and accordingly fix on a recording medium. Hence, the temperature of thus heated intermediate transfer medium inevitably becomes high. This gives rises to a problem that when the heat gets transmitted to a latent image carrier such as a photosensitive drum and a photosensitive belt, the latent image carrier is adversely affected. To solve the problem, the intermediate transfer medium is heated on the upstream side to a secondary transfer position (transfer/fixing position) (as described in Japanese Patent Application Laid-Open Gazette No. H11-167295 for instance; Patent Document 1). An alternative approach is to dispose a cooling apparatus on the downstream side to the secondary transfer position (Japanese Patent Application Laid-Open Gazette No. 2002-123114; Patent Document 2).

However, the image forming apparatus described in the Patent Document 1 requires merely to dispose heating means on the upstream side to the secondary transfer position and heat up the intermediate transfer medium prior to secondary transfer, but does not provide any particular consideration upon the temperature of the intermediate transfer medium at the secondary transfer position. This may lead to a situation that the temperature of the intermediate transfer medium fails to decrease sufficiently and adversely affects the latent image carrier.

On the contrary, in the image forming apparatus described in the Patent Document 2, since the cooling apparatus is disposed on the downstream side to the secondary transfer position, it is possible to lower the temperature of the intermediate transfer medium and accordingly prevent an adverse influence upon the latent image carrier. However, to dispose such a cooling apparatus gives rise to a problem that a cost of the apparatus and the size of the apparatus increase.

There further is the following problem which is common to the conventional apparatuses described above. That is, in the conventional apparatuses described above, the recording medium is brought into pressure contact with the intermediate transfer medium which has been heated the upstream side to the secondary transfer position without considering the temperature of the intermediate transfer medium at the secondary transfer position at all. Because of this, the pressure contact may drastically change the water content of the recording medium, which may result in inconveniences such as wrinkles and curls.

SUMMARY OF THE INVENTION

A major object of the present invention is to provide an image forming apparatus for and an image forming method of performing double-sided printing according to which it is possible to realize excellent double-sided printing yet through simple transfer control.

Other object of the present invention is to provide an image forming apparatus and an image forming method according to which it is possible to transfer and fix a toner image carried by an intermediate transfer medium onto a recording medium without thermally influencing a latent image carrier.

Another object of the present invention is to provide, at a low cost, an image forming apparatus and an image forming method which allow transfer and fixing of a toner image carried by an intermediate transfer medium onto a recording medium without causing inconveniences such as wrinkles and curls of the recording medium.

According a first aspect of the present invention, a primarily transferred toner image, which is formed on a intermediate transfer medium, is heated before secondarily transferring onto a recording medium. Thereafter, the heated toner image is secondarily transferred and concurrently fixed on the recording medium while cooling the intermediate transfer medium.

According a second aspect of the present invention, a toner image is transferred onto one side surface of a recording medium at a first stage transfer step and then fixed at a fixing temperature of 100° C. or lower on one side surface of the recording medium. This for the purpose of suppressing a reduction of the water content of the recording medium. Thereafter, a toner image on the image carrier is transferred onto the other side surface of the recording medium under the same transfer condition to that used at the first stage transfer step.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

<First Embodiment>

Figure 1:
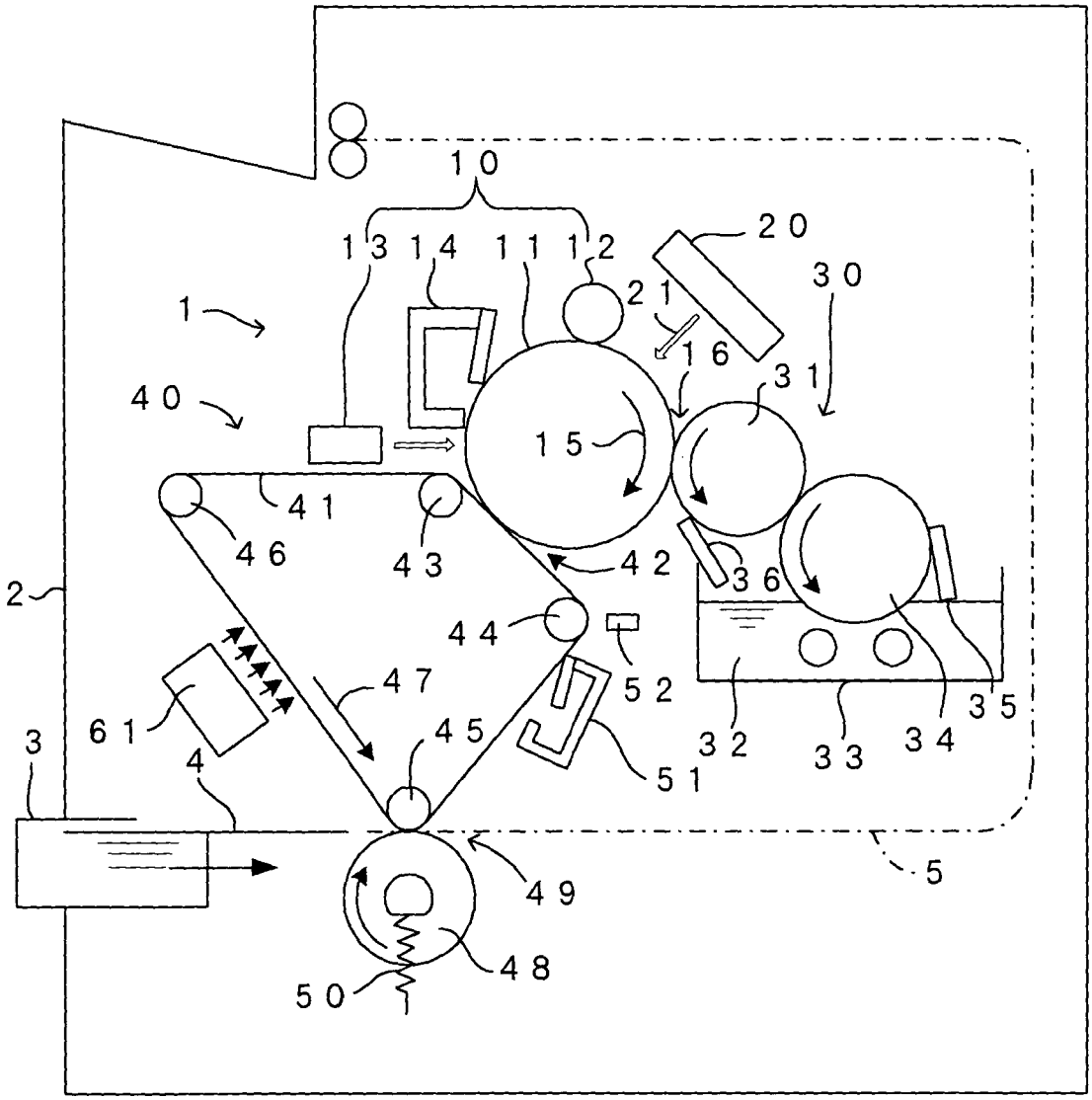
FIG. 1 is a drawing which shows an internal structure of a printer which is a first embodiment of an image forming apparatus according to the present invention.
Figure 2:
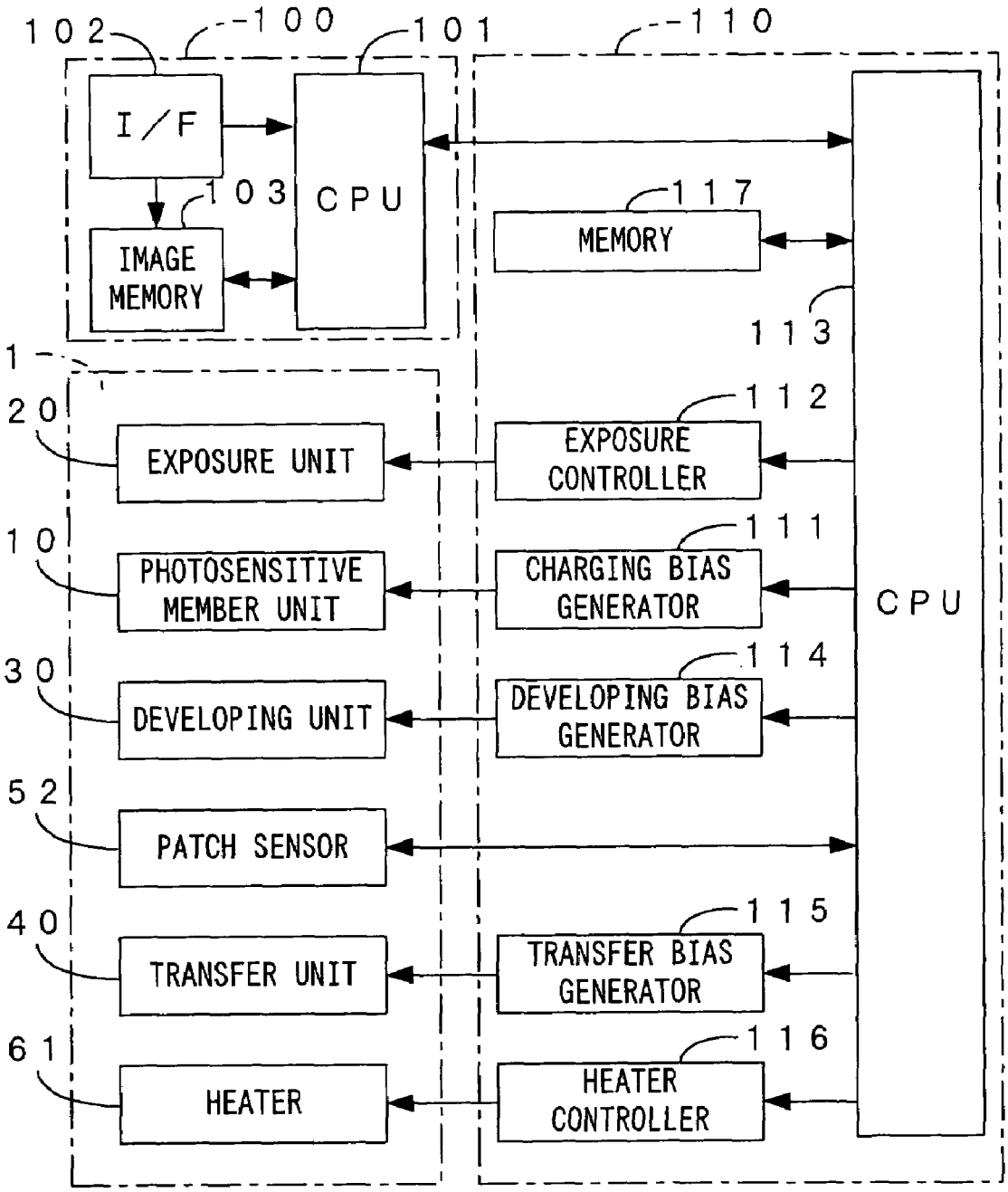
FIG. 2 is a block diagram which shows an electric structure of the printer which is shown in FIG. 1.

FIG. 1 is a drawing which shows an internal structure of a printer which is a first embodiment of an image forming apparatus according to the present invention. FIG. 2 is a block diagram which shows an electric structure of this printer. This printer is an image forming apparatus of the wet developing method which forms a monochrome image using a developing agent of black (K). In this printer, as a print instruction signal containing an image signal is fed to a main controller 100 from an external apparatus such as a host computer, an engine controller 110 controls respective portions of an engine section 1 in accordance with a control signal received from the main controller 100. Images which correspond to the image signal mentioned above are printed on a transfer paper, a copy paper and other general paper (hereinafter referred to as a "recording medium") 4 conveyed from a paper feed cassette 3. The cassette 3 is disposed in a lower portion of a main section 2 of the apparatus.

The engine section 1 comprises a photosensitive member unit 10, an exposure unit 20, a developing unit 30, a transfer unit 40, etc. Of these units, in the photosensitive member unit 10, a photosensitive member 11 is disposed for free rotations in the arrow direction 15 shown in FIG. 1 (i.e., in the clockwise direction in FIG. 1). Disposed around the photosensitive member 11 are a charger 12, a developing roller 31, the transfer unit 40, a discharger 13 and a cleaner 14 along the rotation direction 15. The charger 12 is formed by a charging roller in this embodiment. Applied with a charging bias from an charging bias generator 111, the charger 12 uniformly charges an outer circumferential surface of the photosensitive member 11 to a predetermined surface potential Vd (e.g., Vd=DC+600 V), thus functioning as electrifying means.

Meanwhile, a surface area between the charger 12 and the developing roller 31 serves as an irradiation area of a light beam 21 from the exposure unit 20, and an electrostatic latent image is formed in the irradiation area. In short, the exposure unit 20 exposes the photosensitive member 11 with the light beam 21 in accordance with a control instruction which is fed from an exposure controller 112, whereby an electrostatic latent image which corresponds to an image signal is formed on the photosensitive member 11. For instance, when a print instruction signal containing an image signal is fed to a CPU 101 of the main controller 100 via an interface 102 from an external apparatus such as a host computer, in response to an instruction from the CPU 101 of the main controller 100, a CPU 113 outputs a control signal which corresponds to the image signal to the exposure controller 112 at predetermined timing. The exposure unit 20 then irradiates the light beam 21 upon the photosensitive member 11 in accordance with the control instruction from the exposure controller 112, and an electrostatic latent image which corresponds to the image signal is formed on the photosensitive member 11. Meanwhile, when a patch image is to be formed as needed, the CPU 113 provides the exposure controller 112 with a control signal which corresponds to a patch image signal representing a predetermined pattern which has been set in advance (e.g., a solid image, a thin line image, a white thin line image), and an electrostatic latent image which corresponds to this pattern is formed on the photosensitive member 11. In this embodiment, the photosensitive member 11 thus corresponds to a "latent image carrier" of the present invention.

Thus formed electrostatic latent image is visualized with toner which is supplied by means of the developing roller 31 of the developing unit 30. The developing unit 30 comprises: the developing roller 31; a tank 33 which holds a liquid developer 32; an application roller 34 which scoops up the liquid developer 32 stored in the tank 33 and applies the liquid developer 32 upon the developing roller 31; a restricting blade 35 which restricts the thickness of a layer of the developing agent on the application roller 34 into uniform thickness; and a cleaning blade 36 which removes the developing agent which remains on the developing roller 31 after the toner has been supplied to the photosensitive member 11. The developing roller 31 rotates at the same circumferential speed as the photosensitive member 11 in a direction which follows the photosensitive member 11 (i.e., in the anti-clockwise direction in FIG. 1). On the other hand, the application roller 34 rotates approximately at double the circumferential speed in the same direction as the developing roller 31 (i.e., in the anti-clockwise direction in FIG. 1).

The liquid developer 32 is obtained by dispersing, within a carrier liquid, toner particles which are formed by a color pigment, an adhesive agent such as an epoxy resin which bonds the color pigment, a carrier control agent which applies a predetermined potential upon toner, a dispersing agent which uniformly disperses the color pigment, etc. In this embodiment, silicon oil such as polydimethyl siloxane oil is used as the carrier liquid, and a toner concentration is 5 through 40 w % which is a higher concentration than that of a low-concentration liquid developer which is often used in the wet developing method (and whose toner concentration is 1 through 2 w %). The type of the carrier liquid is not limited to silicon oil, and the viscosity of the liquid developer 32 is determined by materials of the carrier liquid which is used and the toner, a toner concentration, etc. In this embodiment, the viscosity is 50 through 6000 mPa·s for example which is a higher viscosity than that of a low-concentration developing agent.

In the developing unit 30 having such a structure, the application roller 34 scoops up the liquid developer 32 stored in the tank 33 and the restricting blade 35 restricts the thickness of the developing agent layer on the application roller 34 into uniform thickness. The uniform liquid developer 32 adheres to a surface of the developing roller 31, and as the developing roller 31 rotates, the uniform liquid developer 32 is transported to a developing position 16 which is faced with the photosensitive member 11. Owing to a function of the carrier control agent and the like, the toner is electrified positively for example. At the developing position 16 therefore, the toner moves toward the photosensitive member 11 from the developing roller 31 because of a developing bias Vb which is applied upon the developing roller 31 by a developing bias generator 114, and an electrostatic latent image is accordingly visualized. The developing bias Vb is determined through an optimization process which uses a patch image. For instance, approximately Vb=DC+400 V is used.

As the photosensitive member 11 rotates, a toner image formed on the photosensitive member 11 in the manner described above is transported to a primary transfer position 42 which is opposed against an intermediate transfer belt 41 which corresponds to an "intermediate transfer medium" of the present invention. The intermediate transfer belt 41 extends across a plurality of rollers 43 through 46, and when driven by a drive motor not shown, rotates at the same circumferential speed as the photosensitive member 11 in a direction (the anti-clockwise direction in FIG. 1) 47 which follows the photosensitive member 11. As a transfer bias generator 115 applies a primary transfer bias (which may be DC−400 V for instance), the toner image formed on the photosensitive member 11 is primarily transferred onto the intermediate transfer belt 41. The discharger 13 formed by an LED or the like removes an electric charge remaining on the photosensitive member 11 after the primary transfer, and the cleaner 14 removes the liquid developer which remains.

A roller 48 is disposed facing the bottom-most roller 45 among the rollers 43 through 46 around which the intermediate transfer belt 41 extends. The primarily transferred toner image which has been primarily transferred onto the intermediate transfer belt 41 is transported to a secondary transfer position 49 which is between the rollers 45 and 48, as the intermediate transfer belt 41 rotates. An urging member 50 such as a coil spring and a blade spring is linked to the roller 48, and the roller 48 is urged against the roller 45 by the urging member 50. On the other hand, a recording medium 4 housed in a paper feed cassette 3 is transported to the secondary transfer position 49 by a transportation driver (not shown), in synchronization to the transportation of the primarily transferred toner image. The roller 48 rotates at the same circumferential speed as the intermediate transfer belt 41 in a direction (the clockwise direction in FIG. 1) which follows the intermediate transfer belt 41, and therefore, as the transfer bias generator 115 applies a secondary transfer bias (which may be −100 $\mu$A for example under constant current control) upon the roller 48, the primarily transferred toner image on the intermediate transfer belt 41 is secondarily transferred onto the recording medium 4.

In this manner, the rollers 45 and 48 function as "secondary transfer means" of the present invention in this embodiment. The roller 45 corresponds to a "back surface side roller" which rotates while abutting on the intermediate transfer belt 41 on the back surface side to the intermediate transfer belt 41, whereas the roller 48 corresponds to a "front surface side roller" which rotates while abutting on the recording medium 4 on the front surface side to the intermediate transfer belt 41 and which transports the recording medium 4. With the front surface side roller 48 urged against the back surface side roller 45 by the urging member 50, the front surface side roller 48 and the back surface side roller 45 bring the intermediate transfer belt 41 and the recording medium 4 into pressure contact with each other at the secondary transfer position 49. In this embodiment, with respect to each one of the front surface side roller 48 and the back surface side roller 45, the roller's thermal capacity per unit surface area is larger than that of the intermediate transfer belt 41. Further, the thermal capacity per unit surface area of the back surface side roller 45 is larger than the thermal capacity per unit surface area of the front surface side roller 48. As for the special consideration upon the thermal capacities of the rollers 45 and 48 in this embodiment, the reason and the effect will be described in detail later.

In addition, on the upstream side to the secondary transfer position 49 along the rotating direction 47 of the intermediate transfer belt 41, a radiant heater such as a heating lamp is disposed as a heater 61 on the front surface side to the intermediate transfer belt 41. As a heater controller 116 provides the heater 61 with electricity, the heater 61 activates and heats up the primarily transferred toner image on the intermediate transfer belt 41 while remaining not contact with the primarily transferred toner image. In this embodiment, the heater 61 thus functions as "heating means" of the present invention. The temperature of the primarily transferred toner image on the intermediate transfer belt 41 is increased up to or beyond the melting point of the toner particles prior to secondary transfer, thereby melting the toner particles. The feature that the heater 61 may be used as the "heating means" is similarly applicable to the embodiments will be described later.

Thus heated primarily transferred toner image is transported to the secondary transfer position 49, and then secondarily transferred and fixed on the recording medium 4. Following this, the recording medium 4 which has thus received the secondarily transferred toner image is transported along a predetermined transfer paper transportation path 5 (denoted at the dashed line in FIG. 1), and drop into a output tray which is disposed in an upper portion of the main section 2 of the apparatus.

In FIG. 1, denoted at 51 is a cleaner which removes the liquid developer which remains on the intermediate transfer belt 41 after the secondary transfer, while denoted at 52 is a patch sensor formed by a reflection type optical sensor which detects the density of a patch image formed on the photosensitive member 11. In FIG. 2, the main controller 100 comprises an image memory 103 which stores an image signal fed from an external apparatus via the interface 102. The CPU 101, when receiving via the interface 102 a print instruction signal containing an image signal from an external apparatus, converts the signal into job data which are in an appropriate format to instruct the engine section 1 to operate, and sends the data to the engine controller 110. A memory 117 of the engine controller 110 is formed by a ROM which stores a control program for the CPU 113 containing preset fixed data, a RAM which temporarily stores control data for the engine section 1, the result of a calculation performed by the CPU 113 and the like, etc.

Operations of the image forming apparatus having such a structure will now be described. In this image forming apparatus, when a print instruction signal is fed from an external apparatus, the main controller 100 creates job data which are in an appropriate format to instruct the engine section 1 to operate based on the print instruction signal, and feeds the data to the engine controller 110. Receiving the job data, the engine controller 110 forms an electrostatic latent image which corresponds to the print instruction signal on the photosensitive member 11 in accordance with the job data. After the developing unit 30 has developed the electrostatic latent image thereby creating a toner image, the toner image is primarily transferred onto the surface of the intermediate transfer belt 41 at the primary transfer position 42, and a primarily transferred toner image is obtained.

As the intermediate transfer belt 41 rotates, the primarily transferred toner image is transported to the secondary transfer position 49. Before the primarily transferred toner image arrives at the secondary transfer position 49, however, the heater 61 heats up the toner image up to or beyond the melting point of the toner particles and the primarily transferred toner image accordingly melts. At this stage, the intermediate transfer belt 41 gets heated up together as the primarily transferred toner image is heated up.

Thus heated primarily transferred toner image is transported to the secondary transfer position 49, as it is molten. Meanwhile, in synchronization to the rotations of the intermediate transfer belt 41, the recording medium 4 housed in the paper feed cassette 3 is transported to the secondary transfer position 49. When the intermediate transfer belt 41 and the recording medium 4 move passed the secondary transfer position 49 as they remain nipped between the back surface side roller 45 and the front surface side roller 48, the intermediate transfer belt 41 and the recording medium 4 come into pressure contact with each other and the primarily transferred toner image is secondarily transferred and fixed at the same time on the recording medium 4.

In this embodiment, the thermal capacity per unit surface area of each one of the front surface side roller 48 and the back surface side roller 45 is larger than the thermal capacity per unit surface area of the intermediate transfer belt 41. Hence, at the secondary transfer position 49, the primarily transferred toner image which has melted is brought into pressure contact with the recording medium 4 and transferred and fixed on the recording medium 4 in the manner described above, concurrently with which the heat of the intermediate transfer belt 41 is transmitted to the front surface side roller 48 and the back surface side roller 45 and the temperature of the intermediate transfer belt 41 decreases. In other words, at the secondary transfer position 49, the transfer/fixing process is executed while cooling the intermediate transfer belt 41.

Further, at the secondary transfer position 49, when the recording medium 4 is brought into pressure contact with the intermediate transfer belt 41, the temperature of the recording medium 4 increases and the water content of the recording medium 4 drops down extremely, which may lead to inconveniences such as wrinkles and curls. However, the front surface side roller 48 and the back surface side roller 45 absorb the heat from the intermediate transfer belt 41 and accordingly suppress a temperature hike of the recording medium 4. Therefore, it is possible to suppress a reduction in water content of the recording medium 4 and prevent wrinkles, curls, etc.

The recording medium 4 to which the primarily transferred toner image has been transferred and fixed is transported along the transfer paper transportation path 5 in this manner, and dropped into the output tray which is disposed in the upper portion of the main section 2 of the apparatus.

As described above, in this embodiment, the front surface side roller 48 and the back surface side roller 45 which function as the secondary transfer means not only secondarily transfer and fix a toner image on the recording medium 4 but also cool the intermediate transfer belt 41 and accordingly suppress a temperature hike of the recording medium 4, thereby realizing the following effect. That is, since the intermediate transfer belt 41 is cooled at the secondary transfer position 49, a thermal influence over the photosensitive member 11 is prevented without using any special cooling apparatus. Further, in this embodiment, the intermediate transfer belt 41 abuts on the cleaner 51 and the roller 44 on the way from the secondary transfer position 49 to the primary transfer position 42 and gets deprived of heat. In this aspect as well, the structure of the apparatus according to this embodiment is advantageous to suppress a thermal influence over the photosensitive member 11.

In addition, the front surface side roller 48 and the back surface side roller 45 absorb the heat from the intermediate transfer belt 41 and accordingly suppress a temperature hike of the recording medium 4. Hence, it is possible to suppress an extreme change of the water content of the recording medium 4 which has been brought into contact with the intermediate transfer belt 41, and prevent inconveniences such as wrinkles and curls of the recording medium 4. In view of suppression of a water content change, it is desirable to suppress the temperature of the recording medium 4 at the secondary transfer position 49 down to or beyond the boiling point of water. In short, when a temperature hike of the recording medium 4 is suppressed to the boiling point of water, the recording medium 4 is effectively prevented from getting wrinkled or curled. It is further preferable that the melting point of the toner particles is equal to or lower than the boiling point of water. This is because use of such toner particles ensures that a surface temperature of the intermediate transfer belt 41, too, which is heated by the heater 61 which serves as the heating means, which is advantageous in preventing the recording medium 4 from getting wrinkled or curled without allowing the temperature of the recording medium 4 contacting the intermediate transfer belt 41 to exceed the boiling point of water.

Further, in this embodiment, the thermal capacity per unit surface area of the back surface side roller 45 is larger than the thermal capacity per unit surface area of the front surface side roller 48. Therefore, the heat from the intermediate transfer belt 41 is more easily transmitted to the back surface side roller 45 than to the front surface side roller 48 via the recording medium 4. This works to an advantage to suppression of a temperature increase of the recording medium 4. In other words, it is possible to even more effectively prevent inconveniences such as wrinkles and curls of the recording medium 4.

<Second Embodiment>

Figure 3:
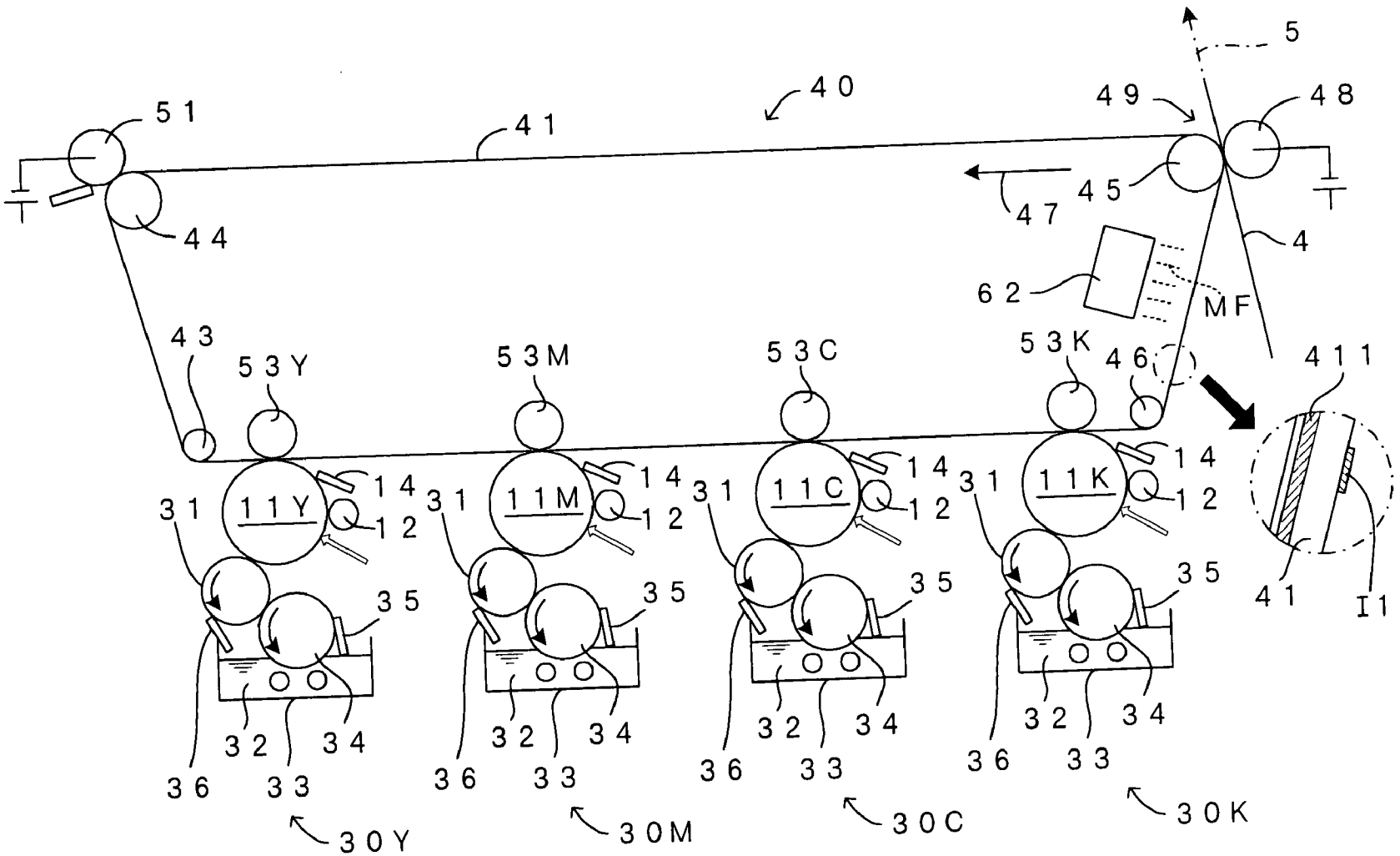
FIG. 3 is a drawing which shows an internal structure of a printer which is a second embodiment of the image forming apparatus according to the present invention.

FIG. 3 is a drawing which shows an internal structure of a printer which is a second embodiment of the image forming apparatus according to the present invention. A major difference of the second embodiment from the first embodiment is that the image forming apparatus is an image forming apparatus of the tandem type which comprises a photosensitive member unit, an exposure unit and a developer unit for each color of black (K), cyan (C), magenta (M) and yellow (Y) for formation of a color image; that a conductive heater member 411 is disposed to the intermediate transfer belt 41; and that an alternating field generator 62 is disposed as the heating means on the back surface side to the intermediate transfer belt 41. The structure is basically otherwise the same as that according to the first embodiment. Hence, the same structures will be denoted at the same reference symbols and will not be described again.

In this embodiment, photosensitive members 11K, 11C, 11M and 11Y are disposed for the respective colors, and so are developing units 30K, 30C, 30M and 30Y and so are primary transfer rollers 53K, 53C, 53M and 53Y As for the yellow color for instance, an electrostatic latent image is formed on the photosensitive member 11Y based on job data from the main controller 100, and after the developing unit 30Y has developed the electrostatic latent image and accordingly formed a toner image, the toner image is primarily transferred onto the surface of the intermediate transfer belt 41 at a primary transfer position 42Y, whereby a primarily transferred toner image is obtained. This is exactly the same as for the other toner colors.

In the image forming apparatus having such a structure, toner images in the respective colors of black (K), cyan (C), magenta (M) and yellow (Y) are formed respectively on the photosensitive members 11K, 11C, 11M and 11Y and these toner images are superimposed one atop the other on the surface of the intermediate transfer belt 41, so that a primarily transferred full-color toner image is formed. The primarily transferred toner image is then transported to the secondary transfer position 49, as the intermediate transfer belt 41 rotates. Before the primarily transferred toner image arrives at the secondary transfer position 49, however, the alternating field generator 62 heats up the toner image up to or beyond the melting point of the toner particles and the primarily transferred toner image accordingly melts. In other words, as an alternating field MF developed by the alternating field generator 62 is applied upon the intermediate transfer belt 41, heat develops at the conductive heater member 411. The heat heats up and melts the toner particles of the primarily transferred toner image I1 (which is shown in the enlarged section in FIG. 3), and also heats up the intermediate transfer belt 41.

Thus heated primarily transferred toner image is transported to the secondary transfer position 49, as it is molten. Meanwhile, in synchronization to the rotations of the intermediate transfer belt 41, the recording medium 4 housed in the paper feed cassette 3 is transported to the secondary transfer position 49. The primarily transferred toner image is then secondarily transferred and fixed on the recording medium 4 as in the first embodiment described earlier.

In this embodiment, too, as in the first embodiment described earlier, the thermal capacity per unit surface area of each one of the front surface side roller 48 and the back surface side roller 45 is larger than the thermal capacity per unit surface area of the intermediate transfer belt 41, and the thermal capacity per unit surface area of the back surface side roller 45 is larger than the thermal capacity per unit surface area of the front surface side roller 48. Hence, a similar effect to that according to the first embodiment is attained. That is, since the intermediate transfer belt 41 is cooled at the secondary transfer position 49, a thermal influence over the photosensitive member 11 is prevented without using any special cooling apparatus. Further, the front surface side roller 48 and the back surface side roller 45 absorb the heat from the intermediate transfer belt 41 and accordingly suppress a temperature hike of the recording medium 4, it is possible to suppress an extreme change of the water content of the recording medium 4 which has been brought into contact with the intermediate transfer belt 41, and prevent inconveniences such as wrinkles and curls of the recording medium 4.

In addition, while the second embodiment requires to dispose the alternating field generator 62 which serves as the heating means on the back surface side to the intermediate transfer belt 41, i.e., on the inner side as viewed from the intermediate transfer belt 41 which rotates, the alternating field generator 62 may be located on the front surface side to the intermediate transfer belt 41. For a reduction of the size of the apparatus, however, it is advantageous to dispose the alternating field generator 62 on the back surface side to the intermediate transfer belt 41. The feature that the alternating field generator 62 may be used as the "heating means" of the present invention is similarly applicable to the other embodiments.

<Third Embodiment>

Figure 4:
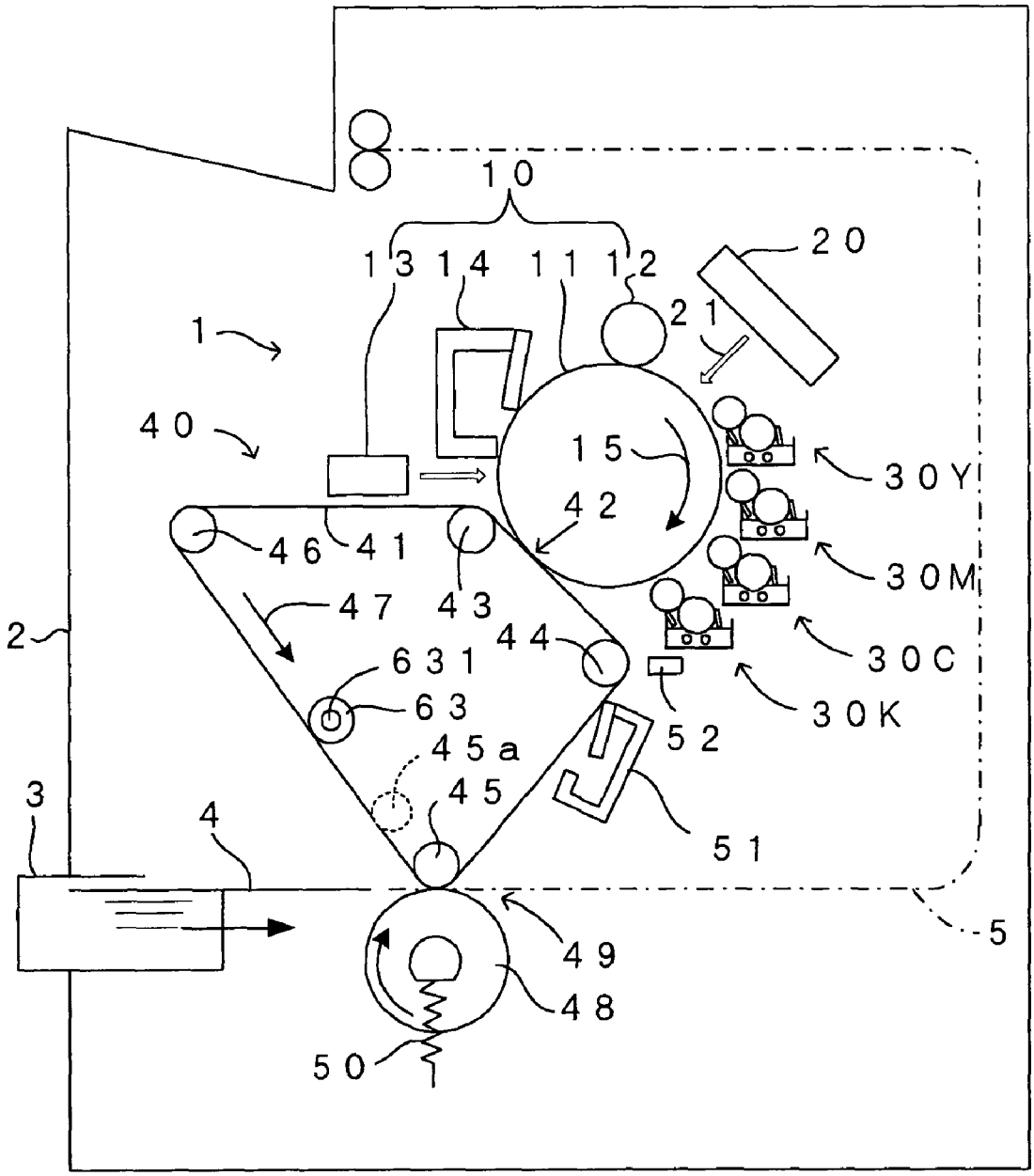
FIG. 4 is a drawing which shows an internal structure of a printer which is a third embodiment of the image forming apparatus according to the present invention.

FIG. 4 is a drawing which shows an internal structure of a printer which is a third embodiment of the image forming apparatus according to the present invention. A major difference of the third embodiment from the first embodiment is that there are developing units disposed for the respective colors of black (K), cyan (C), magenta (M) and yellow (Y) for the purpose of forming a color image; and that a roller heater 63 which internally comprises a heating lamp 631 such as a halogen lamp is used as the heating means. The structure is basically otherwise the same as that according to the first embodiment. Hence, the same structures will be denoted at the same reference symbols and will not be described again.

This embodiment uses developing units 30K, 30C, 30M and 30Y respectively for the respective toner colors. The developing units 30K, 30C, 30M and 30Y can move away from and abut on the photosensitive member 11 independently of each other. As for the yellow color for instance, an electrostatic latent image for the yellow color is formed on the photosensitive member 11 based on job data from the main controller 100, and after the developing unit 30Y selectively abuts on the photosensitive member 11, develops the electrostatic latent image and accordingly forms a toner image, the toner image is primarily transferred onto the surface of the intermediate transfer belt 41 at the primary transfer position 42, whereby a primarily transferred toner image is obtained. This is exactly the same as for the other toner colors.

In the image forming apparatus having such a structure, toner images in the respective colors of black (K), cyan (C), magenta (M) and yellow (Y) are formed, and these toner images are superimposed one atop the other on the surface of the intermediate transfer belt 41, so that a primarily transferred full-color toner image is formed. At the stage that the toner images in the four colors have been superimposed one atop the other, the roller heater 63 heats up the primarily transferred toner image up to or beyond the melting point of the toner particles and the primarily transferred toner image accordingly melts before the primarily transferred toner image arrives at the secondary transfer position 49. In other words, the heating lamp 631 turns on and the temperature of the roller heater 63 increases at this stage. The roller heater 63 rotates while abutting on the back surface of the intermediate transfer belt 41 on the back surface side to the intermediate transfer belt 41, thereby heating the intermediate transfer belt 41. In consequence, the toner particles of the primarily transferred toner image are heated and melted.

Thus heated primarily transferred toner image is transported to the secondary transfer position 49, as it is molten. Meanwhile, in synchronization to the rotations of the intermediate transfer belt 41, the recording medium 4 housed in the paper feed cassette 3 is transported to the secondary transfer position 49. The primarily transferred toner image is then secondarily transferred and fixed on the recording medium 4 as in the first embodiment described earlier.

In this embodiment, too, as in the first embodiment described earlier, the thermal capacity per unit surface area of each one of the front surface side roller 48 and the back surface side roller 45 is larger than the thermal capacity per unit surface area of the intermediate transfer belt 41, and the thermal capacity per unit surface area of the back surface side roller 45 is larger than the thermal capacity per unit surface area of the front surface side roller 48. Hence, a similar effect to that according to the first embodiment is attained. That is, since the intermediate transfer belt 41 is cooled at the secondary transfer position 49, a thermal influence over the photosensitive member 11 is prevented without using any special cooling apparatus. Further, the front surface side roller 48 and the back surface side roller 45 absorb the heat from the intermediate transfer belt 41 and accordingly suppress a temperature hike of the recording medium 4, it is possible to suppress an extreme change of the water content of the recording medium 4 which has been brought into contact with the intermediate transfer belt 41, and prevent inconveniences such as wrinkles and curls of the recording medium 4.

In addition, requiring that the roller heater 63 which serves as the heating means is disposed on the back surface side to the intermediate transfer belt 41, i.e., on the inner side as viewed from the intermediate transfer belt 41 which rotates, the third embodiment is advantageous in reducing the size of the apparatus. Further, although the roller heater 63 is used as a contact heater in this embodiment, other contact heater such as a blade heater may be used instead. The feature that a contact heater may be used as the "heating means" of the present invention is similarly applicable to the other embodiments.

<Fourth Embodiment>

Figure 5:
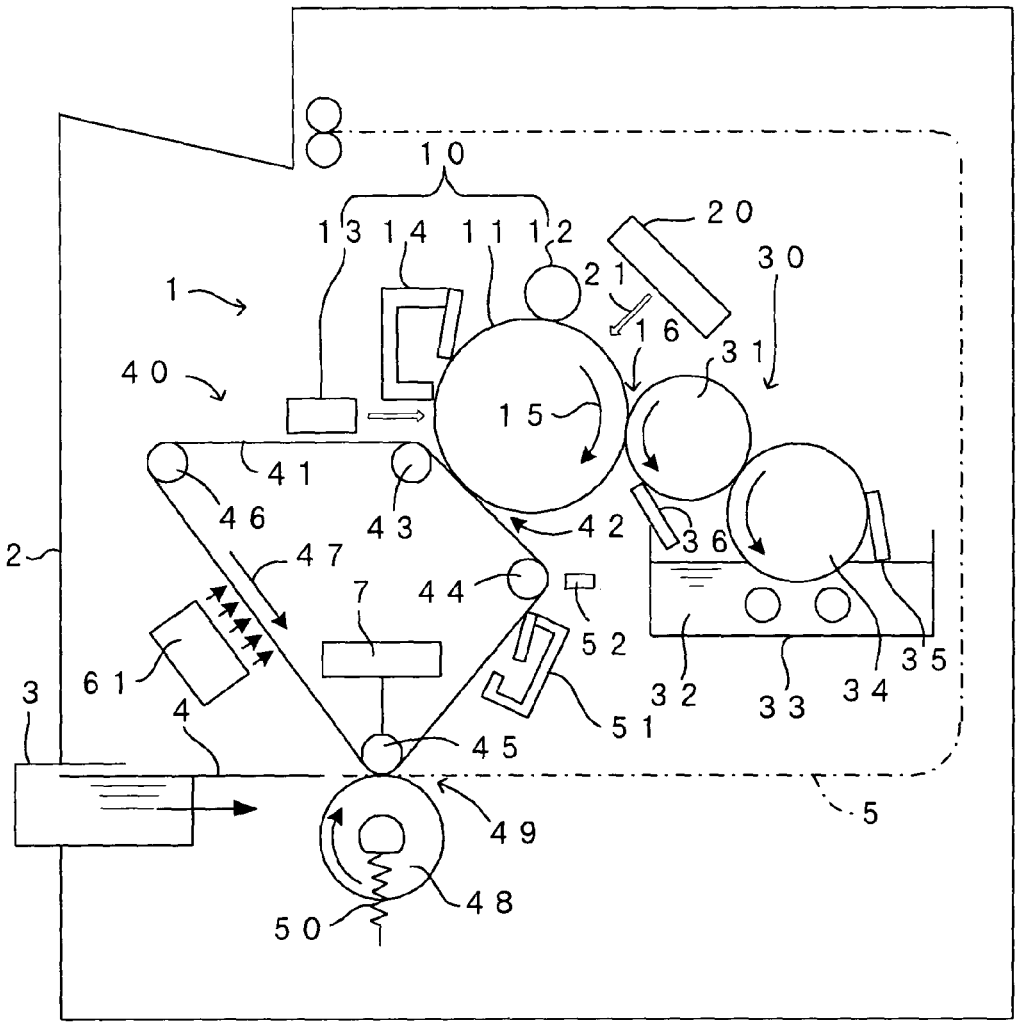
FIG. 5 is a drawing which shows an internal structure of a printer which is a fourth embodiment of the image forming apparatus according to the present invention.

FIG. 5 is a drawing which shows an internal structure of a printer which is a fourth embodiment of the image forming apparatus according to the present invention. A major difference of the fourth embodiment from the first embodiment is that the fourth embodiment further comprises a temperature adjuster 7 which is linked to the back surface side roller 45 and adjusts a surface temperature of the roller 45. The structure is basically otherwise the same as that according to the first embodiment. Hence, the same structures will be denoted at the same reference symbols and will not be described again.

The temperature adjuster 7 detects a surface temperature of the back surface side roller 45 and adjusts the surface temperature of the back surface side roller 45 in such a manner that the surface temperature will be constant. Since the back surface side roller 45 absorbs the heat from the intermediate transfer belt 41 and invites a temperature increase, the temperature adjuster 7 is preferably a heat pipe or the like. With the surface temperature of the back surface side roller 45 thus adjusted, it is always possible to properly cool down the intermediate transfer belt 41 and suppress a temperature hike of the recording medium 4. As a result, it is possible to further effectively obviate a thermal influence over the photosensitive member 11 and prevent the recording medium 4 from getting wrinkled or curled.

Although the embodiments described above require that the thermal capacity per unit surface area of each one of the front surface side roller 48 and the back surface side roller 45 is larger than the thermal capacity per unit surface area of the intermediate transfer belt 41, a similar effect to that according to the embodiments described above is attained also when at least one of the two rollers has such a structure. In other words, since the intermediate transfer belt 41 is cooled at the secondary transfer position 49, a thermal influence over the photosensitive member 11 is prevented without using any special cooling apparatus. Further, since the heat from the intermediate transfer belt 41 is absorbed and a temperature hike of the recording medium 4 is suppressed, it is possible to suppress an extreme change of the water content of the recording medium 4 which has been brought into contact with the intermediate transfer belt 41, and prevent inconveniences such as wrinkles and curls of the recording medium 4.

Still further, although the embodiments described above require to use the intermediate transfer belt 41 as the "intermediate transfer medium" of the present invention, the present invention is applicable also to an image forming apparatus which uses an intermediate transfer drum. The present invention is applicable to an image forming apparatus which uses an intermediate transfer drum, e.g., the apparatus described in the Patent Document 1. To be more specific, in this apparatus, with a pressure roller brought into contact with an intermediate transfer drum at a secondary transfer position, a primarily transferred toner image is secondarily transferred and fixed on a recording medium. Hence, when the apparatus is structured such that thermal capacity per unit surface area of the pressure roller is larger than the thermal capacity per unit surface area of the intermediate transfer drum, a similar effect to that according to the embodiments described above is attained.

Further, although the embodiments described above require to use the front surface side roller 48 and the back surface side roller 45 as the "secondary transfer means" of the present invention, the secondary transfer means may be such means having a conventional structure. For instance, according to the Patent Document 1, the pressure roller disposed on the front surface side to the intermediate transfer medium (which corresponds to the "front surface side roller" of the present invention) functions as the "secondary transfer means" of the present invention. Meanwhile, the apparatus described in the Patent Document 2 comprises a fixing roll and a belt nip device at a secondary transfer position, and secondary transfer and fixing is executed as these elements function as the "secondary transfer means" of the present invention. Further, within the secondary transfer means, a back surface side auxiliary roller which rotates while abutting on the intermediate transfer medium may be disposed in some cases on the back surface side to the intermediate transfer medium and on the downstream side to the heating means along the rotating direction of the intermediate transfer medium but the upstream side to the secondary transfer position. These diversified structures have been proposed as for the secondary transfer means, and the present invention is applicable to these secondary transfer means in general. In other words, when a primarily transferred toner image is secondarily transferred and fixed on the recording medium while the secondary transfer means cools down the intermediate transfer medium, a similar effect to that according to the embodiments described above is attained.

Further, although the fourth embodiment described above applies the temperature adjuster 7 which serves as "temperature adjusting means" of the present invention to the image forming apparatus according to the first embodiment, applications of the temperature adjuster 7 are not limited to this. It is needless to mention that the temperature adjuster 7 is applicable also to the second embodiment, the third embodiment, etc. Further, although the temperature adjuster 7 adjusts the temperature of the back surface side roller 45 alone according to the fourth embodiment, the temperature adjuster 7 may adjust the temperature of the front surface side roller 48, too.

Further, the transfer bias generator 115 which corresponds to "transfer bias applying means" of the present invention applies a secondary transfer bias upon the secondary transfer means in the embodiments described above, whether to apply the secondary transfer bias may be freely determined.

Further, although the embodiments described above are an application of the present invention to an image forming apparatus of the wet developing type, the present invention is applicable also to an image forming apparatus of the so-called dry developing type, and particularly, an image forming apparatus in which an electrostatic latent image on a latent image carrier is visualized with a developing agent consisting only of toner particles and the toner image is accordingly formed on the latent image carrier.

<Fifth Embodiment>

Figure 6:
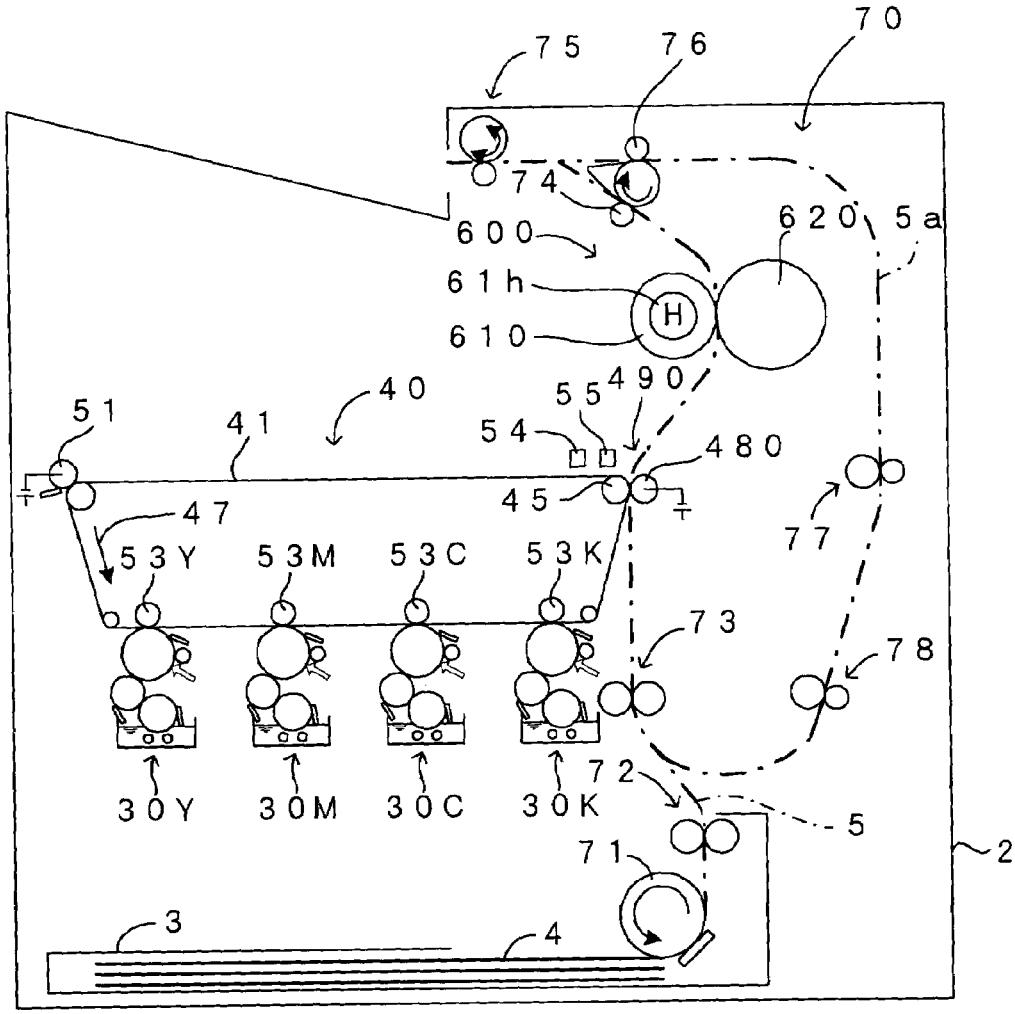
FIG. 6 is a drawing which shows an internal structure of a printer which is an embodiment of the image forming apparatus according to the present invention.
Figure 7:
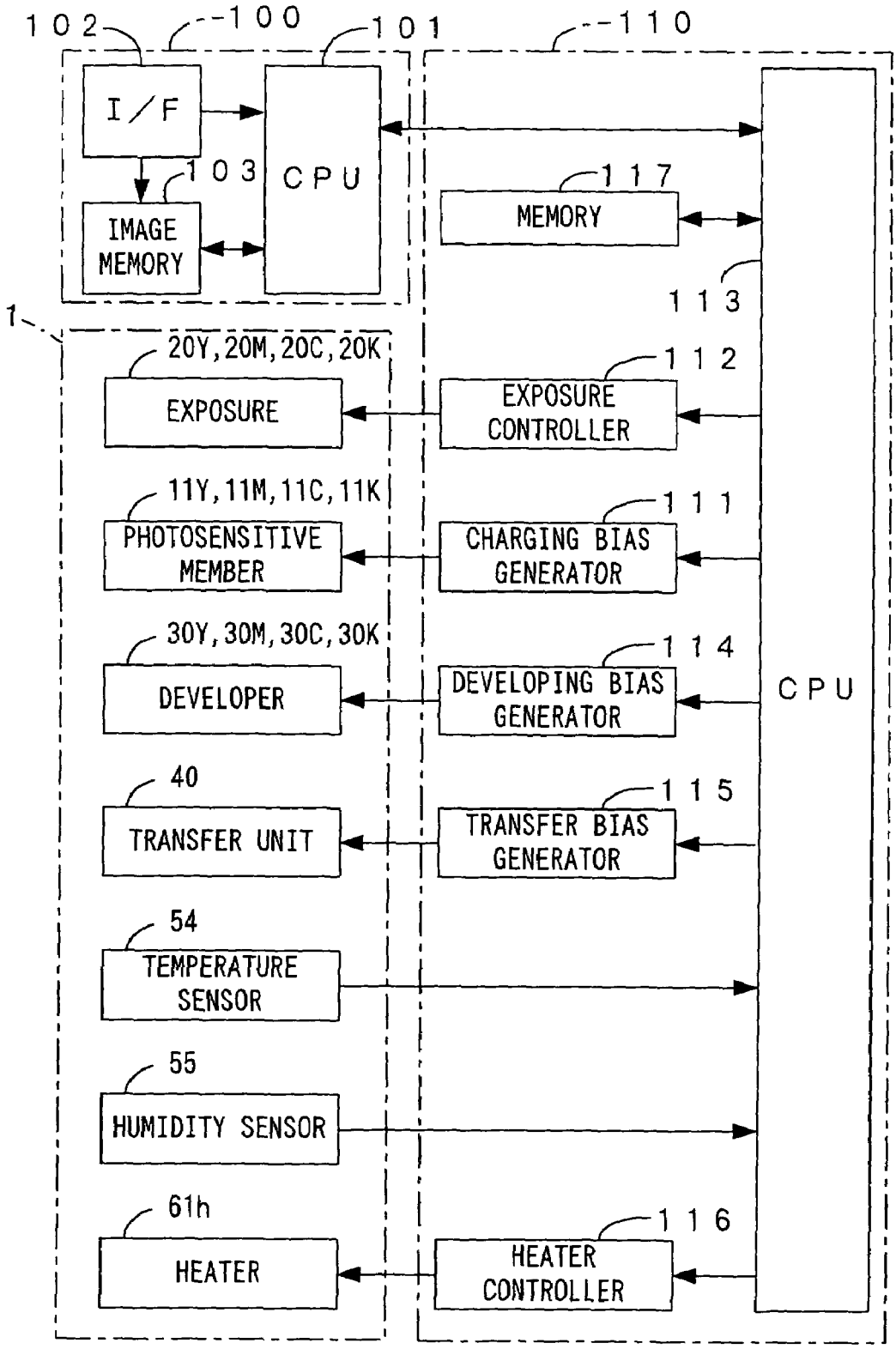
FIG. 7 is a block diagram which shows an electric structure of the printer which is shown in FIG. 6.
Figure 8:
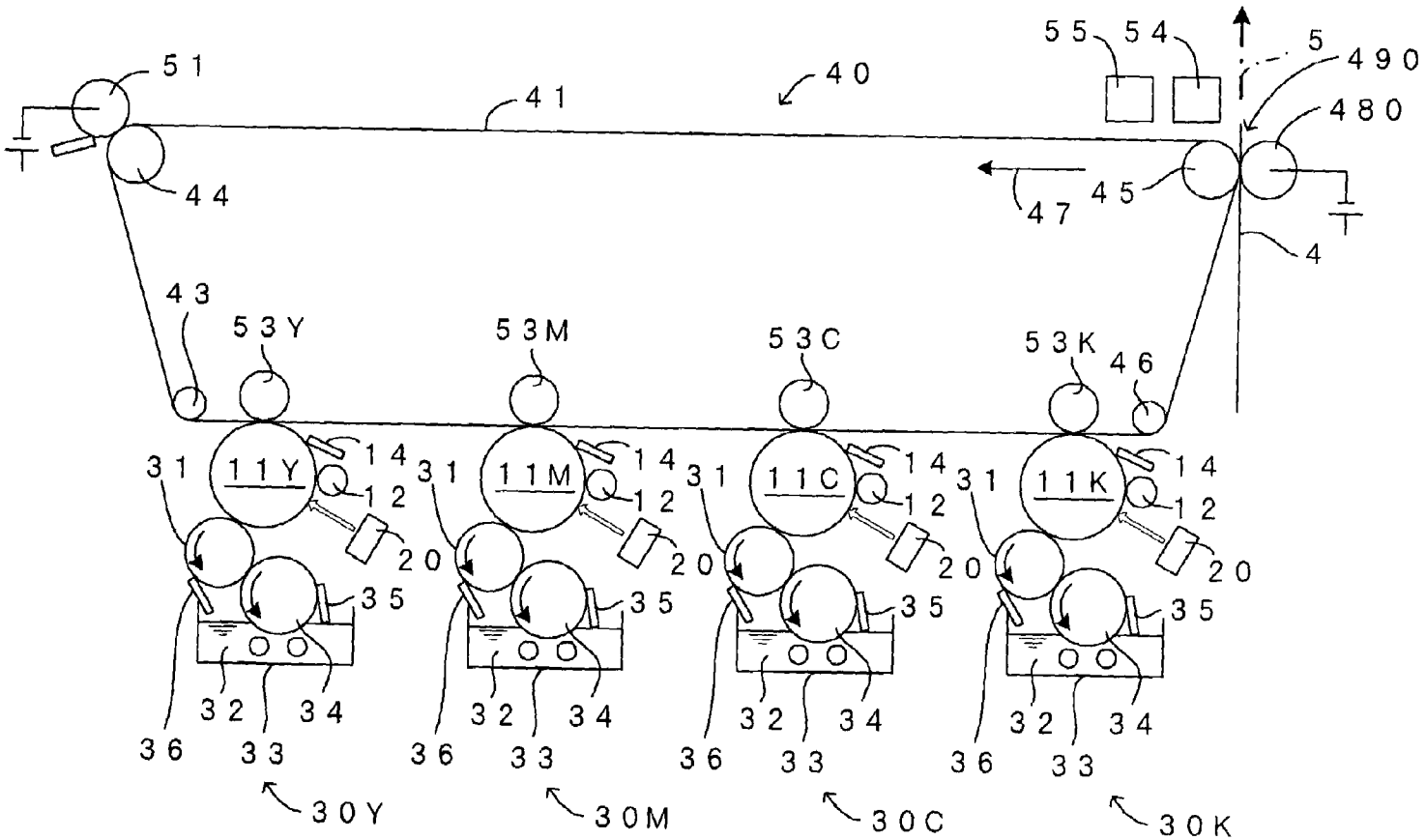
FIG. 8 is a partially expanded view of the printer which is shown in FIG. 6.

FIG. 6 is a drawing which shows an internal structure of a printer which is a fifth embodiment of the image forming apparatus according to the present invention. FIG. 7 is a block diagram which shows an electric structure of the printer. FIG. 8 is a partially expanded view of the printer which is shown in FIG. 6. This printer is an image forming apparatus of the wet developing type which superimposes toner colors in four colors of yellow (Y), magenta (M), cyan (C) and black (K) one atop the other and accordingly forms a full-color image, or uses only toner in black (K) and accordingly forms a monochrome image. In this printer, when a print instruction signal containing an image signal is fed to the main controller 100 from an external apparatus such as a host computer, the engine controller 110 controls respective portions of the engine section 1 in accordance with a control signal received from the main controller 100 and an image is accordingly formed. In short, an image corresponding to the image signal mentioned above is printed on the recording medium 4, such as a transfer paper, a copy paper and other general paper, which has been transported from the paper feed cassette 3 which is disposed in the lower portion of the main section 2 of the apparatus.

In the engine section 1, process units for yellow (Y), magenta (M), cyan (C) and black (K) are disposed along the rotating direction 47 of the intermediate transfer belt 41 which corresponds to an "image carrier" of the present invention. These process units have the same structure as the process unit according to the second embodiment. Noting this, the process units will be denoted at the same reference symbols and will not be described again.

In this printer, too, as in the second embodiment, toner images in yellow (Y), magenta (M), cyan (C) and black (K) are formed in accordance with an image signal and superimposed one atop the other on the surface of the intermediate transfer belt 41 respectively at the positions of the primary transfer rollers 53K, 53C, 53M and 53Y, whereby a full-color toner image is formed. The process units for the four colors thus function as "image forming means" of the present invention which forms a toner image on the intermediate transfer belt 41.

As the intermediate transfer belt 41 rotates, toner images thus formed on the intermediate transfer belt 41 are transported to a secondary transfer position 490 which is located between rollers 45 and 480. Meanwhile, the recording medium 4 housed in the paper feed cassette 3 (FIG. 6) is transported to the secondary transfer position 490 by a transportation unit 70 which will be described in detail later, in synchronization to the transportation of the primarily transferred toner images. The roller 480 rotates at the same circumferential speed as the intermediate transfer belt 41 in a direction (the clockwise direction in FIG. 6) which follows the intermediate transfer belt 41. As the transfer bias generator 115 applies a secondary transfer bias upon the roller 480, the toner images on the intermediate transfer belt 41 are secondarily transferred onto the recording medium 4. Thus, the plurality of rollers form the transfer unit 40 which transfers a toner image, and of these rollers, the rollers 45 and 480 function as "transfer means" which transfers a toner image carried on the intermediate transfer belt 41 onto the recording medium 4, and execute a transfer process under a transfer condition which meets a transfer environment detected by sensors which will be described in the following. Requiring to utilize roller transfer, this embodiment permits to set up a transfer condition under constant voltage control and set up transfer condition under constant current control. Transfer may be realized by means of corona discharge instead of roller transfer, in which case a transfer condition is set by controlling a corona discharge output.

The transfer unit 40 comprises the cleaner 51 which removes the developing agent which remains on the intermediate transfer belt 41 after the secondary transfer. In addition, there are a temperature sensor 54 and a humidity sensor 55 which detect an ambient environment around the secondary transfer position. Output signals from the temperature sensor 54 and the humidity sensor 55 are sent to the CPU 113, which in turn makes it possible to detect a transfer environment.

The recording medium 4 to which the toner image has been secondarily transferred in the manner described above is transported along the predetermined transfer paper transportation path 5 (denoted at the dashed line in FIG. 6), a fixing unit 600 which serves as "fixing means" of the present invention fixes the toner image on the recording medium 4, and the recording medium 4 bearing the toner image is ejected into the output tray which is disposed in the upper portion of the main section 2 of the apparatus. The fixing unit 600 comprises a heating roller 610 which internally has a heater 61*h*, and a pressure roller 620 which contacts the heating roller 610. As the heater controller 116 controls activation of the heater 61*h*, a fixing temperature at the fixing unit 600 is adjusted to any desired temperature. In this embodiment, the heater controller 116 adjusts the fixing temperature to 100° C. or lower for a reason which will be described later.

In the image forming apparatus according to this embodiment, there is the transportation unit 70 which transports the recording medium 4 along the predetermined transfer paper transportation path 5. In the transportation unit 70, as shown in FIG. 6, a paper feed roller 71 is disposed to correspond to the paper feed cassette 3. The paper feed roller 71 unloads the recording mediums 4 housed in the paper feed cassette 3 one at a time, and transports each recording medium 4 to a feed roller 72. The feed roller 72 transports the recording medium 4 to a gate roller 73, and the recording medium 4 is kept on standby temporarily at the position of the gate roller. At such timing which corresponds to the secondary transfer operation, the gate roller 73 drives and feeds the recording medium 4 to the secondary transfer position 490 as described above. There are a pre-eject roller 74, an eject roller 75 and a reversing roller 76 disposed on the output tray side. The recording medium 4 thus subjected to secondary transfer is transported toward the output tray side via the fixing unit 600, the pre-eject roller 74 and the eject roller 75.

Since it is necessary to reverse the recording medium 4 and transport the same back to the gate roller 73 once again for the purpose of double-sided printing, the eject roller 75 can rotate forward and backward. In short, when the recording medium 4 is to be transported to the output tray, the eject roller 75 keeps rotating forward and transports the recording medium 4 completely to the output tray. On the other hand, when the recording medium is to be reversed and re-fed, when the rear edge of the recording medium 4 arrives at a predetermined position which is between the pre-eject roller 74 and the eject roller 75, the eject roller 75 rotates backward and sends the recording medium 4 to the reversing roller 76. The recording medium 4 is thus transported to a re-feed intermediate roller 77 along a reverse path 5*a*. The re-feed intermediate roller 77 and a re-feed pre-gate roller 78 transport the recording medium 4 to the gate roller 73, and the recording medium 4 is kept on standby temporarily at the position of the gate roller. The recording medium 4 is thus reversed and re-fed.

In FIG. 7, the main controller 100 comprises the image memory 103 which stores an image signal fed from an external apparatus via the interface 102. The CPU 101, when receiving via the interface 102 a print instruction signal containing an image signal from an external apparatus, converts the signal into job data which are in an appropriate format to instruct the engine section 1 to operate, and sends the data to the engine controller 110. The memory 117 of the engine controller 110 is formed by a ROM which stores a control program for the CPU 113 containing preset fixed data, a RAM which temporarily stores control data for the engine section 1, the result of a calculation performed by the CPU 113 and the like, etc.

Figure 9:
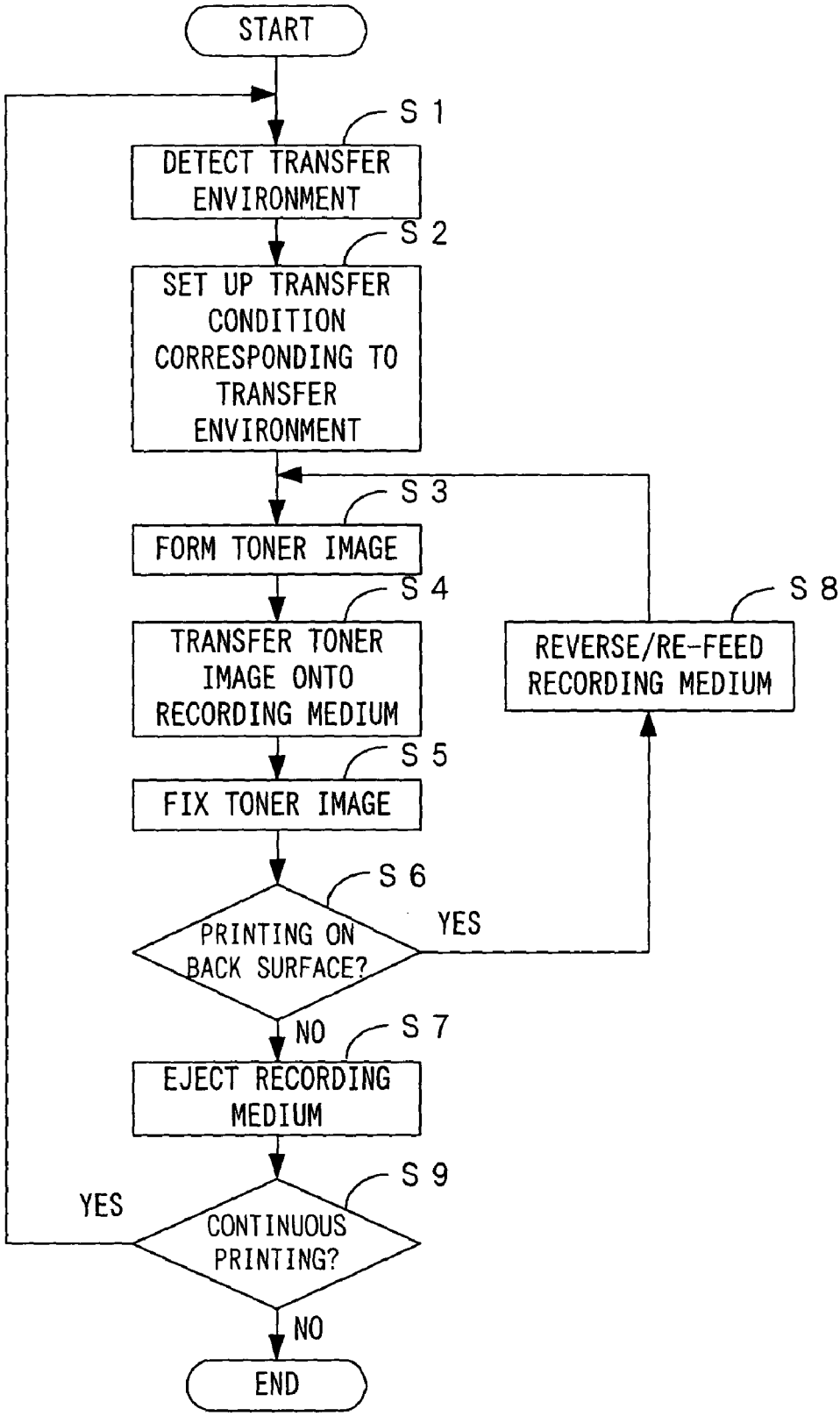
FIG. 9 is a flow chart which shows double-sided printing operations of the printer which is shown in FIG. 6.

FIG. 9 is a flow chart which shows double-sided printing operations of the printer which is shown in FIG. 6. Double-sided printing operations of the image forming apparatus having such a structure will now be described with reference to FIG. 9. In this image forming apparatus, when a print instruction signal is fed from an external apparatus, the main controller 100 creates job data which are in an appropriate format to instruct the engine section 1 to operate based on the print instruction signal, and sends the data to the engine controller 110. In the engine controller 110 receiving the job data, the CPU 113 controls respective portions of the engine section 1 in accordance with the control program which is inside the memory 117 and double-sided printing is executed.

First, at a step S1, the CPU 113 of the engine controller 110 detects an ambient environment around the secondary transfer position 490, namely, a transfer environment based on output signals from the temperature sensor 54 and the humidity sensor 55. The reason of this is because characteristics such as electric resistance rates of the intermediate transfer belt 41, the recording medium 4 and the like change depending on a transfer environment. Noting this, the transfer environment is detected in advance and a transfer condition corresponding to the transfer environment is set (Step S2), so that the secondary transfer process will be executed always under an excellent transfer condition. In this embodiment, transfer conditions corresponding to a transfer environment are stored in advance as a table in the memory 117, which makes it possible for the CPU 113 to identify a transfer condition which meets the transfer environment which has been detected at the step S1. In this embodiment, the CPU 113 functions as "transfer condition determining means" of the present invention. Of course, output results obtained by the temperature sensor 54 and the humidity sensor 55 may be substituted in a function expression to thereby yield a transfer condition, instead of using the table.

As the transfer condition is set up in the manner described above, toner images which will be printed on the surface (one side surface) of the recording medium 4 are formed on the intermediate transfer belt 41 based on the job data (Step S3). In other words, electrostatic latent images in the respective colors which correspond to the print instruction signal are formed respectively on the photosensitive members 11Y, 11M, 11C and 11K. After the developing units 30Y, 30M, 30C and 30K have respectively developed the electrostatic latent images in the respective colors, these toner images are primarily transferred and superimposed one atop the other on the surface of the intermediate transfer belt 41 at respective primary transfer positions, whereby a color toner image is formed on the intermediate transfer belt 41. In parallel to this, the recording medium 4 is transported from the paper feed cassette 3 to the gate roller 73 at proper timing, and kept on standby.

At the next step S4, the color toner image on the intermediate transfer belt 41 is secondarily transferred onto the surface of the recording medium 4 while the recording medium 4 is transported from the gate roller 73 to the secondary transfer position 490 (a first stage transfer step). The recording medium 4 is then transported to the fixing unit 600, and the toner image is fixed on the surface of the recording medium 4 (Step S5: a first stage fixing step). While the fixing temperature in the fixing unit 600 is adjusted to 100° C. or lower in this embodiment, this is for the purpose of suppressing a reduction of the water content of the recording medium 4. In other words, this is to suppress evaporation of the water content of the recording medium 4 at the first stage fixing step and accordingly lessen a variation in electric resistance rate of the recording medium 4 even after execution of the first stage fixing step. That is, in this embodiment, with the fixing temperature adjusted to 100° C. or lower at the first stage fixing step, a change in characteristics of the recording medium 4 is suppressed which would be otherwise caused by fixing, and the recording medium 4 as it is after the fixing process is maintained substantially in the same state as how the recording medium 4 used to be prior to the first stage fixing.

The recording medium 4 processed at the first stage fixing step in this manner is transported toward the output tray, and during the transportation, whether it is necessary to print on the back surface of the recording medium 4 is determined (Step S6). When the job is to perform single-sided printing, the sequence proceeds directly to a step S7. When the job is to perform double-sided printing however, it is determined at the step S6 that printing on the back surface is needed and reversing/re-feeding (Step S8) of the recording medium 4 and the series of processes described above (Step S3 through Step S5) is executed.

For printing on the back surface, the recording medium 4 is transported to the gate roller 73 along the reverse path 5*a* as described above, and the recording medium 4 is kept on standby temporarily at the position of the gate roller (Step S8). Through the reversing/re-feeding, the recording medium 4 is turned around upside down.

A toner image for printing on the back surface (the other side surface) of the recording medium 4 is formed on the intermediate transfer belt 41 based on the job data (Step S3). While transporting the recording medium 4 from the gate roller 73 to the secondary transfer position 49, the color toner image on the intermediate transfer belt 41 is secondarily transferred onto the back surface of the recording medium 4 under the same transfer condition as that used at the first stage transfer step (Step S4: a second stage transfer step). The recording medium 4 is then transported to the fixing unit 600 and the toner image is fixed on the back surface of the recording medium 4 (Step S5: a second stage fixing step). The recording medium 4 is thus processed at the second stage fixing step, whereby both surfaces of the recording medium 4 are printed. Then the recording medium 4 is transported toward the output tray. Since printing on the back surface has already completed at this stage, the judgment at the step S6 is "NO" and the sequence proceeds directly to the step S7.

At the step S7, the recording medium 4 now bearing images is dropped into the output tray. While it is determined at a step S9 that continuous printing is needed, the step S1 through the step S8 described above are repeated, whereby the recording mediums 4 bearing images are discharged continuously to the output tray.

As described above, according to this embodiment, since the fixing temperature is set to 100° C. or lower at the first stage fixing step, it is possible to maintain the recording medium 4 which is being re-fed substantially in the same state as how the recording medium 4 used to be prior to the first stage fixing step. It is further possible to form toner images on any one of the surfaces of the recording medium 4 favorably since the transfer condition at the second stage fixing step is set to the same as the transfer condition at the first stage fixing step. Since the transfer condition is thus common to the front and the back surfaces of the recording medium 4, it is possible to simplify the transfer control.

Further, although this embodiment requires that the transfer condition remains common at the first step and the second stage transfer step, the common transfer condition is set depending on a transfer environment. Therefore, even when characteristics of the intermediate transfer belt 41, the recording medium 4 and the like change due to an ambient environment such as a temperature and a humidity level, it is possible to transfer toner images onto the front and the back surfaces of the recording medium 4 always under an appropriate transfer condition. And hence, form toner images having even better image qualities on the recording medium.

Further, since it is possible to suppress a decrease of the water content of the recording medium 4 as much as possible with the fixing temperature set to 100° C. or lower at the first stage fixing step, inconveniences such as wrinkles and curls of the recording medium 4 are prevented. In an image forming apparatus which performs double-sided printing in particular, there is the reverse path 5*a* disposed which is for reversing/re-feeding of the recording medium 4 processed at the first stage printing step to the secondary transfer position 49 and the recording medium 4 subjected to the first stage fixing is forcibly reversed along the reverse path 5*a*, and therefore, even a minor wrinkle or curl could lead to interference and jamming of the recording medium 4 with the reverse path 5*a*. Noting this, as compared with an image forming apparatus which is dedicated only to single-sided printing, an image forming apparatus which performs double-sided printing is relatively less tolerable against wrinkles and curls of the recording medium 4. However, since it is possible to effectively prevent wrinkles, curls and the like according to this embodiment as described above, there is a higher level of freedom of designing the reverse path 5*a* and the occurrence of jamming is reduced, which is considerably advantageous for an image forming apparatus which performs double-sided printing.

Although the heater controller 116 adjusts the fixing temperature to 100° C. or lower and fixing is executed at this fixing temperature at both the first stage fixing step and the second stage fixing step according to the fifth embodiment described above, the second stage fixing step may be carried out at a fixing temperature beyond 100° C. That is, while it is essential in the present invention to set the fixing temperature to 100° C. or lower at the first stage fixing step, a fixing temperature for the second stage fixing step may be any desired temperature.

Further, although a toner image is transferred and fixed on the back surface of the recording medium 4 after transferring and fixing a toner image on the front surface of the recording medium 4 in the fifth embodiment described above, the foregoing is directly applicable to where toner images are transferred and fixed in the opposite order. In this case, the back surface to which a toner image is transferred and fixed first corresponds to the "one side surface of the recording medium" of the present invention and the front surface corresponds to the "other side surface of the recording medium" of the present invention.

Further, although the fifth embodiment described above requires to dispose the temperature sensor 54 and the humidity sensor 55 as the "detecting means" of the present invention and to accordingly detect an ambient environment around the secondary transfer position 490 (transfer environment), the structure of the detecting means is not limited to this. Instead, a humidity sensor which is directly relevant to the water content for instance alone may be disposed.

Further, although the fifth embodiment described above requires to detect a transfer environment and set up a transfer condition (Step S2) prior to execution of double-sided printing on each recording medium (Step S1), the timing of executing the same is not limited to this. This may be executed at any appropriate timing, e.g., when an operating time, a continuous printing page count or the like has arrived at a predetermined value.

Further, while the fifth embodiment described above is an application of the present invention to an image forming apparatus which is of the so-called tandem type and performs double-sided printing in color by the wet method, applications of the present invention are not limited to this. Rather, the present invention is generally applicable to image forming apparatuses which perform double-sided printing. For instance, the present invention is applicable also to an image forming apparatus which performs double-sided printing in monochrome, to an image forming apparatus which performs double-sided printing by the so-called dry developing type, to an image forming apparatus of the so-called four cycle method which requires to switch a plurality of developing units for one photosensitive member to thereby form a color toner image, and further to an image forming apparatus which comprises an intermediate transfer drum as the "image carrier" of the present invention.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus in which a toner image carried on a latent image carrier is primarily transferred onto a surface of an intermediate transfer medium which rotates and a primarily transferred toner image thus formed on said intermediate transfer medium is secondarily transferred and fixed at the same time on a recording medium, comprising:

heating means which is disposed between a primary transfer position for said primary transfer and a secondary transfer position for said secondary transfer, and which heats up a primarily transferred toner image before secondarily transferring; and secondary transfer means which is disposed at said secondary transfer position and which secondarily transfers and fixes said primarily transferred toner image on said recording medium while cooling said intermediate transfer medium.

2. The image forming apparatus of claim 1, wherein said secondary transfer means comprises a front surface side roller which is disposed on the front surface side to said intermediate transfer medium at said secondary transfer position, and which rotates while abutting on said recording medium and accordingly transports said recording medium while pressuring said recording medium toward said intermediate transfer medium; and a thermal capacity per unit surface area of said front surface side roller is larger than a thermal capacity per unit surface area of said intermediate transfer medium.

3. The image forming apparatus of claim 2, wherein said secondary transfer means further comprises a back surface side auxiliary roller which is disposed on the back surface side to said intermediate transfer medium on the downstream side to said heating means along the rotating direction of said intermediate transfer medium but the upstream side to said secondary transfer position, and which rotates while abutting on said intermediate transfer medium; and a thermal capacity per unit surface area of said back surface side auxiliary roller is larger than a thermal capacity per unit surface area of said intermediate transfer medium.

4. The image forming apparatus of claim 2, further comprising temperature adjusting means which adjusts a surface temperature of said front surface side roller.

5. The image forming apparatus of claim 2, further comprising transfer bias applying means which applies a transfer bias upon said secondary transfer means to thereby facilitate transfer of toner onto said recording medium from said intermediate transfer medium.

6. The image forming apparatus of claim 1, wherein said secondary transfer means comprises a front surface side roller, which is disposed on the front surface side to said intermediate transfer medium at said secondary transfer position and rotates while abutting on said recording medium and accordingly transports said recording medium, and a back surface side roller which is disposed on the back surface side to said intermediate transfer medium at said secondary transfer position and rotates while abutting on said intermediate transfer medium;

said intermediate transfer medium and said recording medium are firmly held between said front surface side roller and said back surface side roller, and accordingly brought into pressure contact with each other; and a thermal capacity per unit surface area of at least one of said front surface side roller and said back surface side roller is larger than a thermal capacity per unit surface area of said intermediate transfer medium.

7. The image forming apparatus of claim 6, wherein the thermal capacity per unit surface area of said back surface side roller is larger than the thermal capacity per unit surface area of said front surface side roller.

8. The image forming apparatus of claim 6, wherein said secondary transfer means further comprises a back surface side auxiliary roller which is disposed on the back surface side to said intermediate transfer medium on the downstream side to said heating means along the rotating direction of said intermediate transfer medium but the upstream side to said secondary transfer position, and which rotates while abutting on said intermediate transfer medium; and a thermal capacity per unit surface area of said back surface side auxiliary roller is larger than the thermal capacity per unit surface area of said intermediate transfer medium.

9. The image forming apparatus of claim 6, further comprising temperature adjusting means which adjusts a surface temperature of said roller whose thermal capacity per unit surface area is larger than the thermal capacity per unit surface area of said intermediate transfer medium.

10. The image forming apparatus of claim 6, further comprising transfer bias applying means which applies a transfer bias upon said secondary transfer means to thereby facilitate transfer of toner onto said recording medium from said intermediate transfer medium.

11. The image forming apparatus of claim 1, wherein said heating means increases a temperature of toner particles which form said primarily transferred toner image up to or beyond a melting point of said toner particles; and said secondary transfer means ensures that the temperature of said recording medium at said secondary transfer position is equal to or lower than the boiling point of water.

12. The image forming apparatus of claim 11, wherein the melting point of said toner particles is equal to or lower than the boiling point of water.

13. The image forming apparatus of claim 1, wherein said heating means comprises a contact heater which is disposed on the back surface side to said intermediate transfer medium, abuts on a back surface of said intermediate transfer medium and heats up said intermediate transfer medium.

14. The image forming apparatus of claim 1, wherein said intermediate transfer medium comprises a conductive heater member; and said heating means comprises an alternating field generator which applies an alternating field upon said intermediate transfer medium so that said conductive heater member develops heat.

15. The image forming apparatus of claim 14, wherein said alternating field generator is disposed on the back surface side to said intermediate transfer medium.

16. The image forming apparatus of claim 1, wherein said heating means comprises a radiant heater which is disposed on the front surface side to said intermediate transfer medium.

17. The image forming apparatus of claim 1, wherein an electrostatic latent image on said latent image carrier is visualized with a developing agent which contains toner particles and said toner image is formed on said latent image carrier; and said developing agent is a single-component developing agent which is comprised only of toner particles.

18. The image forming apparatus of claim 1, wherein an electrostatic latent image on said latent image carrier is visualized with a developing agent which contains toner particles and said toner image is formed on said latent image carrier; and said developing agent is a liquid developer which is obtained by dispersing toner particles in a carrier liquid.

19. The image forming apparatus of claim 18, wherein a toner concentration within said liquid developer is from about 5 w % to about 40 w %.

20. An image forming method in which a toner image carried on a latent image carrier is primarily transferred onto a surface of an intermediate transfer medium which rotates and a primarily transferred toner image thus formed on said intermediate transfer medium is secondarily transferred and fixed at the same time on a recording medium, comprising:

a heating step of heating a primarily transferred toner image which has not been secondarily transferred yet; and a transferring/fixing step of secondarily transferring and concurrently fixing said primarily transferred toner image on said recording medium while cooling said intermediate transfer medium.

* * * * *